US005921498A

United States Patent [19]

Wessel et al.

[11] Patent Number: 5,921,498

[45] Date of Patent: Jul. 13, 1999

[54] CARROUSEL-TYPE COILER WITH TWO COILER DRUMS

[75] Inventors: Karl-Heinz Wessel, Dinslaken; Dieter Figge, Essen, both of Germany

[73] Assignee: Mannesmann Aktiengesellschaft, Düsseldorf, Germany

[21] Appl. No.: 08/739,413

[22] Filed: Oct. 29, 1996

[30] Foreign Application Priority Data

Nov. 10, 1995 [DE] Germany ..... 195 43 046

[51] Int. Cl.[6] ..... B65H 19/22; B65H 19/20

[52] U.S. Cl. ..... 242/533.6; 242/533.4

[58] Field of Search ..... 242/533.6, 533.4, 242/541.1

[56] References Cited

U.S. PATENT DOCUMENTS

| | | | |
|---|---|---|---|
| 2,923,487 | 2/1960 | Wands et al. | 242/533.6 X |
| 3,985,313 | 10/1976 | Klein et al. | 242/533.6 X |
| 4,790,491 | 12/1988 | Mandus et al. | 242/533.6 X |

FOREIGN PATENT DOCUMENTS 40 70 70 1/1991 European Pat. Off. .

*Primary Examiner*—John Q. Nguyen

*Attorney, Agent, or Firm*—Cohen, Pontani, Lieberman & Pavane

[57] ABSTRACT

A device for winding strip-type material, especially steel strip, alternately on each of two expandable coiler drums arranged horizontally and parallel to one another, which are mounted in free-floating fashion in a carrying frame arranged in rotary-drivable fashion around a shared horizontal central axis and are themselves rotary-drivable independently of one another. The rotary drives for the coiler drums together with the carrying frame are attached to the frame in rotatable fashion. The drum-type carrying frame consists of two vertical circular-disk-type carrying walls which are separated from and parallel to one another. Longitudinal traverses connect the carrying walls together. On the longitudinal traverses are mounted the coiler drums, which penetrate one carrying wall, and their expanding drives. Flanged onto the outside of the other carrying wall are the simultaneously drivable rotary drives, which are connected to the coiler drums through universal joint shafts in geared fashion.

2 Claims, 2 Drawing Sheets

CARROUSEL-TYPE COILER WITH TWO COILER DRUMS

BACKGROUND OF THE INVENTION

1. Field of the Invention

The invention relates to a device for winding strip material, especially steel strip, alternately on one of two expandable coiler drums arranged horizontally and parallel to one another. The coiler drums are mounted in free-floating fashion in a drum-type carrying frame arranged in rotary-drivable fashion around a shared horizontal central axis and can themselves be rotary-driven independently of one another. The rotary drives for the coiler drums together with the carrying frame are attached to the frame in a rotatable fashion.

2. Description of the Prior Art

Winding devices of this type are also known as "turret coilers" and are used in continuous strip plants for hot and cold strip. Such devices can carry out coil changes at very short intervals of time and can thus replace two conventional separate coilers. Winding devices equipped with two coiler drums make it possible for the coiler drum with the coil to be swung into the removal position as an ongoing winding process nears its end. To do this, the carrying frame is rotated around its central axis, while at the same time, the other coiler drum is swung into the ready position for the start of the next winding process. After separation of the strip with fast dividing shears, the beginning of the next strip can be grasped and wound onto the waiting coiler drum without delay.

The known devices of the generic type require rotary drives for the two coiler drums. These rotary drives take the form of two stationary electric motors arranged outside of the carrying frame and connected to the coiler drums by costly overlay gear units. The overlay gear units pass along the drive of each electric motor to the particular coiler drum being driven via a central hollow shaft. This allows the drums to be driven independently of one another at all times, even while the carrying frame is being swung.

However, the disadvantage of the known winding devices is that the drive transfer systems used for the coiler drums, in the form of overlay gear units and numerous translation steps, are extremely complicated and thus expensive, require high-maintenance and are subject to breakdown. The use of known carrousel-type coilers is therefore not economical, especially in smaller strip plants.

SUMMARY OF THE INVENTION

Accordingly, it is an object of the present invention to provide a drive for a generic winding device that can be economically implemented with simple structural means without the use of complicated overlay gear units and which significantly simplifies the known device.

Pursuant to this object, and others which will become apparent hereafter, one aspect of the present invention resides in the drum-type carrying frame having two vertical circular-disk-type carrying walls, which are arranged separately from and parallel to one another. Longitudinal traverses are provided to connect the walls. The coiler drums, which penetrate one carrying wall, and their expanding drives are mounted on the longitudinal traverses. Flanged onto the outside of the other carrying wall are simultaneously drivable rotary drives, which are connected to the coiler drums through the carrying wall via universal joint shafts in a geared fashion.

The proposal to rotate the rotary drives together with the drum-type carrying frame around their shared horizontal central axis makes it possible for the coiler drums to be driven directly, i.e., without the intermediate connection of an overlay gear unit. The omission of the costly gearing with its many translation steps does not subject the drive of the two coilers drums to any limitation.

The carrying frame accommodates the coiler drums and, particularly, their expanding drives in a protective manner. At the same time, the carrying frame carries the rotary drives flanged onto one carrying wall, so that these drives can be rotated around the central axis together with the carrying wall. The rotary drives and the coiler drums are connected to one another via universal joint shafts, which permit the coiler drums to be distributed on the periphery of the carrying wall in offset fashion.

In a further embodiment of the invention, there are annular running rails in the face region of each carrying wall, which coaxially encircle the central axis of the carrying frame and rest in rollable fashion against wheels arranged on the frame. The drum-type carrying frame thus runs solidly on the carrying rollers, which permit the carrying frame to be rotated around the central axis. For the purpose of rotation, there is a conventional rotary drive, which engages into a toothed rim on the carrying frame.

According to another embodiment of the invention, the coiler drum and the universal joint shaft are connected to one another via the respective steps of a spur gearing, which directly transmit the driving motion of each rotary drive. These spur gearings can be produced very simply and much less expensively than the conventional overlay gear units. The spur gearing takes up little space within the carrying frame and is arranged directly between the coiler drum and the universal joint shaft.

Preferably, the rotary drives are designed as electric motors, which are supplied with power via slip rings provided in the region of the central axis. This arrangement ensures that the coiler drums can be driven in every winding position. Compared to the known solution, a device of much simpler design is created, which can be used economically even in smaller plants.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
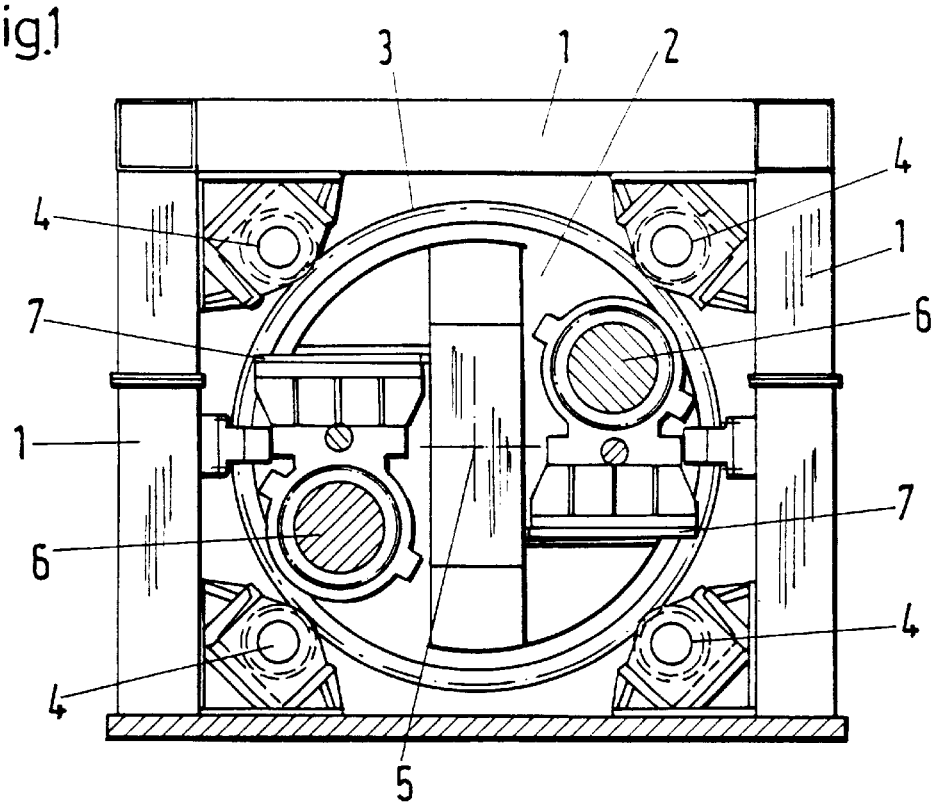
FIG. 1 is a cross-section through the carrying frame of a device according to the present invention.

In FIG. 1, the drum-type carrying frame 2 of the device according to the invention is rotatably mounted in a columnar frame 1. There are annular running rails 3, which rest against four front and rear rollers 4 arranged in the corners of the frame 1. The drum-type carrying frame 2 can be rotated together with the two coiler drums 6 around the central axis 5 by means of drives (not shown). The coiler drums 6 with their expanding drives 9 are attached to longitudinal traverses 7 inside the carrying frame 2 in an overhung manner. The longitudinal traverses 7 are arranged between two circular-disk-type carrying walls 8*a*, 8*b*, which carry the annular running rails 3 on their faces.

Figure 2:
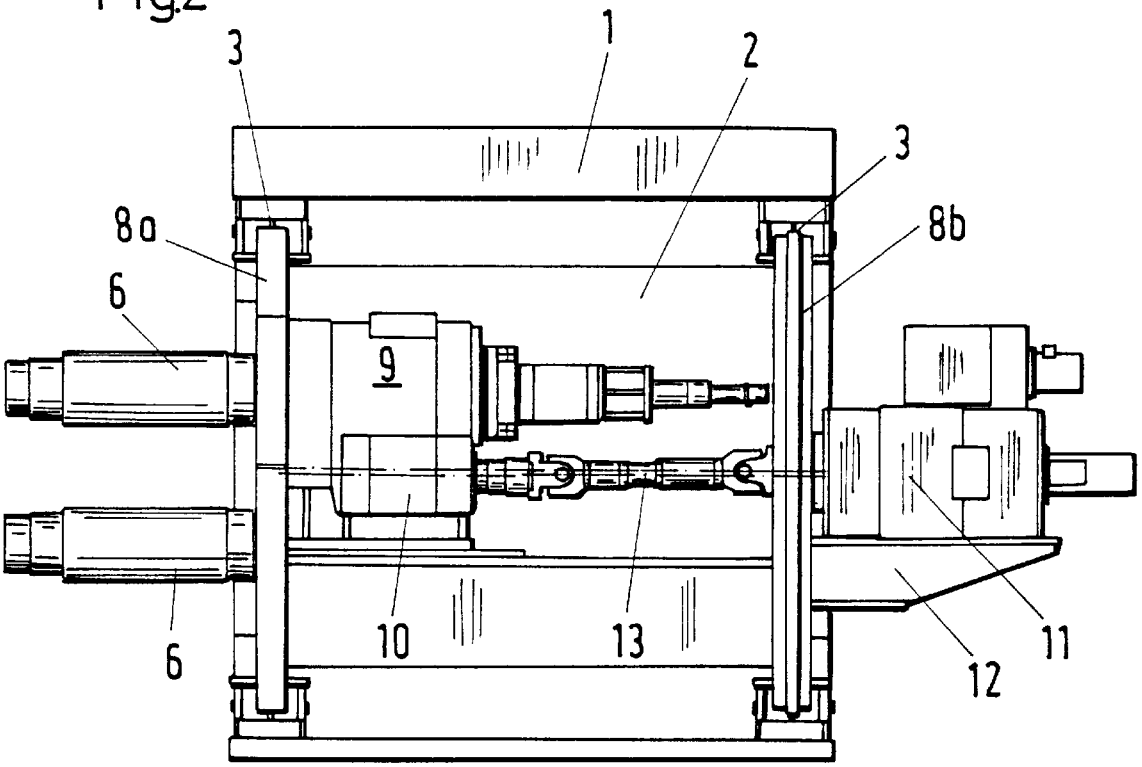
FIG. 2 is a side view of the device in FIG. 1.

As FIG. 2 shows, the coiler drum 6, with its expanding drive 9 and an associated spur gearing 10, is attached to the longitudinal traverse 7. The rotary drives 11 for the coiler drums 6, in the form of electric motors, are attached to a console 12, which is flanged onto the outside of the carrying wall 8*b* of the carrying frame 2. The universal joint shaft 13, which interacts on the side facing away from the rotary drive 11 with the spur gearing 10, which preferably contains a herringbone spur gear, is provided as the drive transfer system between the electric motor (rotary drive 11) and the coiler drum 6. The spur gear corresponds to an identical spur gear on the coiler drum 6. The drive for the second coiler drum is designed in the same fashion. One of the expanding drives and one of the coiler drums are arranged below the console 12, while the other expanding drive and the other coiler drum are arranged above the console 12, so that the two coiler drums are offset relative to the horizontal plane.

Figure 3:
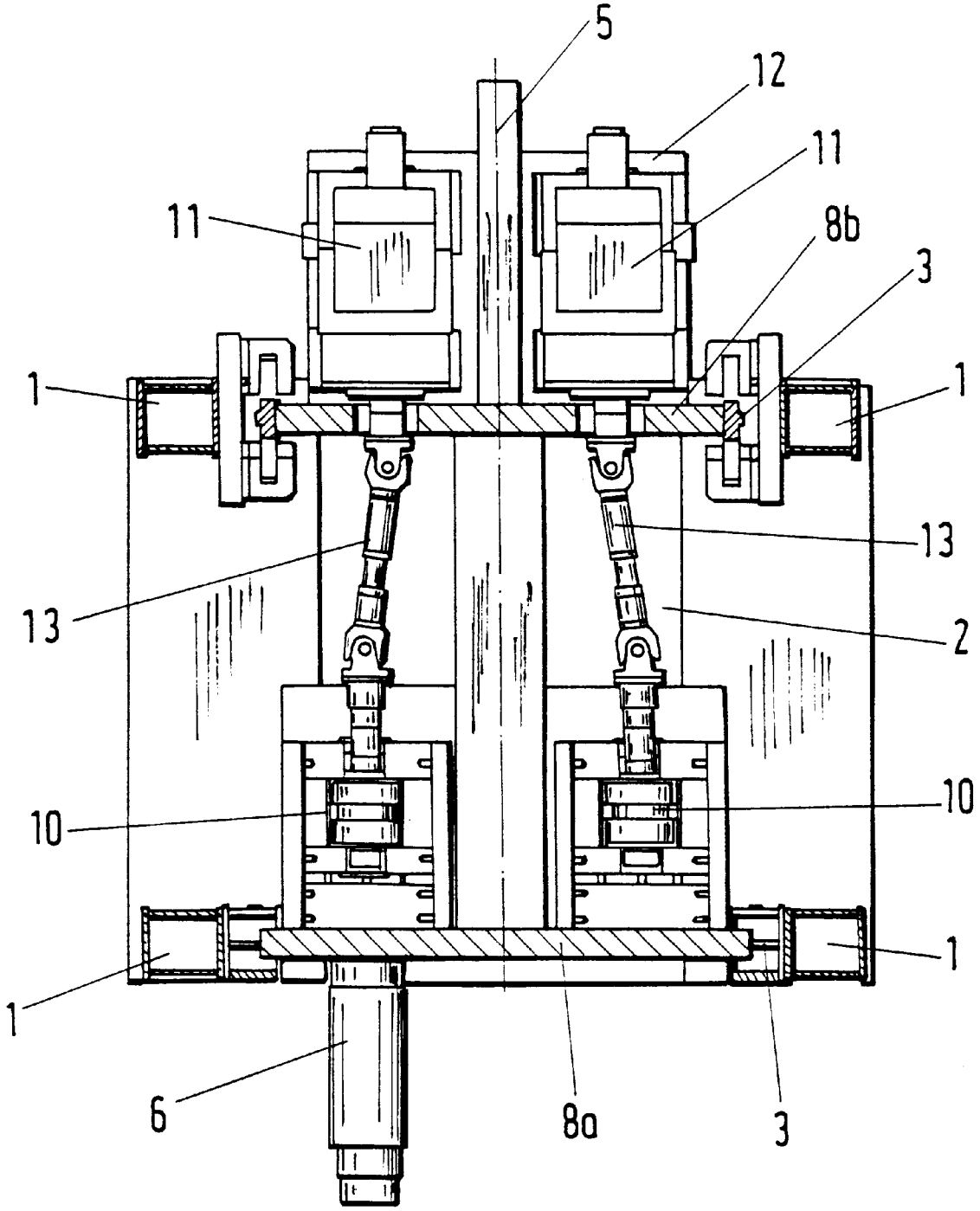
FIG. 3 is a longitudinal section through the device according to the invention in the region of the coiler drums and their rotary drives.

As FIG. 3 shows, the two rotary drives 11 on the console 12 are located on a common plane, while the coiler drums are offset relative to the plane. The universal joint shafts 13, which connect the drive motors 11 to the gearings 10 on the coiler drums 6, furnish the appropriate counterbalance.

The electric motors are fed by ring-slip lines (not shown) provided in the region of the central axis 5. The ring-slip lines permit the drum-type carrying frame 2 to be rotated together with the rotary drives 11 seated thereupon and the two coiler drums to be driven in any rotational position of the carrying frame 2.

The invention is not limited by the embodiments described above which are presented as examples only but can be modified in various ways within the scope of protection defined by the appended patent claims.

We claim:

1. A device for winding steel strip alternately on each of two expandable coiler drums, comprising:

a drum-type carrying frame rotatable about a horizontal central axis, the carrying frame including two vertically oriented circular disk-shaped carrying walls spaced from and parallel to one another, and longitudinal traverses arranged to connect the carrying walls together;

two expandable coiler drums horizontally mounted at one end on the longitudinal traverses of the carrying frame in an overhung manner so as to be parallel to one another and independently rotatably drivable, the coiler drums being arranged to penetrate a first one of the carrying walls;

expanding drives for expanding the coiler drums, the coiler drums and the expanding drives being mounted on the longitudinal traverses;

two simultaneously drivable electric motors for independently driving each of the coiler drums, the electric motors being mounted to a second one of the carrying walls;

universal joint shafts arranged to connect the coiler drums to the electric motors through the second carrying wall in a geared manner annular running rails arranged in a face region of each carrying wall so as to coaxially encompass the central axis of the carrying frame;

a columnar frame arranged to surround the carrying frame; and wheels arranged on the columnar frame, the running rails resting against the wheels so as to be rollable over the wheels.

2. A device for simultaneously winding and unwinding steel-strip material as defined in claim 1, and further comprising spur gear means for connecting the coiler drums and the universal joint shafts to one another in geared fashion.

* * * * *